US008299873B2

(12) United States Patent
Wang et al.

(10) Patent No.: US 8,299,873 B2
(45) Date of Patent: Oct. 30, 2012

(54) MILLIMETER WAVE TRANSMISSION LINE FOR SLOW PHASE VELOCITY

(75) Inventors: Guoan Wang, South Burlington, VT (US); Essam Mina, South Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 980 days.

(21) Appl. No.: 12/342,271

(22) Filed: Dec. 23, 2008

(65) Prior Publication Data

US 2010/0156559 A1 Jun. 24, 2010

(51) Int. Cl.
*H01P 3/08* (2006.01)

(52) U.S. Cl. ..... 333/161; 333/238; 333/246

(58) Field of Classification Search ..... 333/161, 333/238, 246, 247
See application file for complete search history.

(56) References Cited

U.S. PATENT DOCUMENTS

| | | | | |
|---|---|---|---|---|
| 5,097,128 | A | 3/1992 | Jack | |
| 5,287,068 | A * | 2/1994 | Olmstead et al. | 330/9 |
| 5,291,162 | A | 3/1994 | Ito et al. | |
| 5,952,901 | A | 9/1999 | Nakano | |
| 6,559,737 | B1 * | 5/2003 | Nagra et al. | 333/156 |
| 6,650,192 | B2 | 11/2003 | Hayashi | |
| 6,703,894 | B1 * | 3/2004 | Stockstad et al. | 327/552 |
| 6,794,947 | B2 | 9/2004 | Lin | |
| 6,864,757 | B2 * | 3/2005 | du Toit et al. | 333/34 |
| 7,332,983 | B2 * | 2/2008 | Larson | 333/161 |
| 7,561,006 | B2 * | 7/2009 | Dutta | 333/161 |
| 7,852,176 | B2 * | 12/2010 | Chang et al. | 333/246 |
| 2006/0044073 | A1 | 3/2006 | Stoneham | |
| 2008/0048799 | A1 | 2/2008 | Wang et al. | |
| 2009/0195327 | A1 * | 8/2009 | Cho et al. | 333/34 |
| 2009/0315641 | A1 * | 12/2009 | Ding et al. | 333/161 |

FOREIGN PATENT DOCUMENTS

| | | |
|---|---|---|
| JP | 5-251914 | 9/1993 |
| JP | 2007-318348 | 12/2007 |
| JP | 2008-244520 | 10/2008 |
| KR | 2002-0065811 | 8/2002 |

OTHER PUBLICATIONS

Official Action dated May 16, 2011, received from the Korean Intellectual Property Office (KIPO) in related Korean Patent Application No. KR 10-2009-0128070, in Korean.
Official Action dated May 25, 2011, received from the China Patent Office in related Chinese Patent Application No. CN 200910226598.5, in Chinese.

* cited by examiner

*Primary Examiner* — Dean O Takaoka
*Assistant Examiner* — Alan Wong
(74) *Attorney, Agent, or Firm* — Scully, Scott, Murphy & Presser, P.C.; Anthony J. Canale

(57) ABSTRACT

A grounding plate and a transmission line are provided in a stack of dielectric material layers. First transmission line portions having a first width are alternately interlaced with second transmission line portions having a second width in the transmission line. The second width is greater than the first width so that inductance of the transmission line is increased relative to a transmission line having a fixed width. Metal fins may be provided between the grounding plate and the transmission line in the stack of the dielectric material layers. The metal fins may be grounded to the grounding plate to increase capacitance between the transmission line and the grounding plate. The increase in the inductance and the capacitance per unit length between the transmission line and the grounding plate is advantageously employed to provide a reduced phase velocity for electromagnetic signal transmitted through the transmission line. A design structure for the transmission line structure is provided.

35 Claims, 13 Drawing Sheets

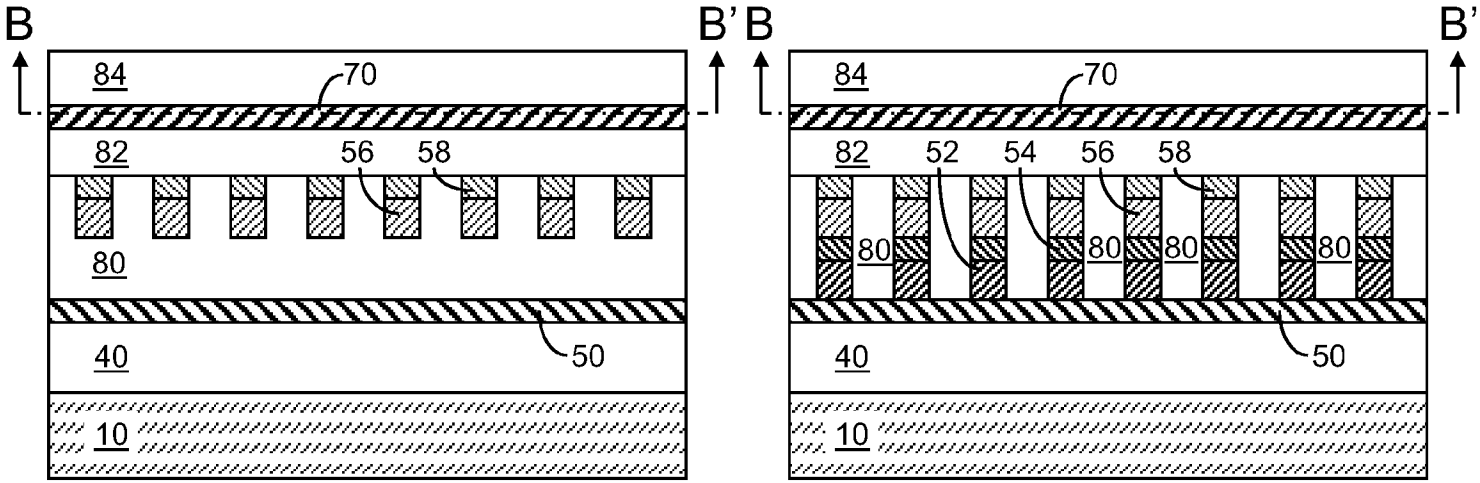
FIG. 7A
FIG. 8A
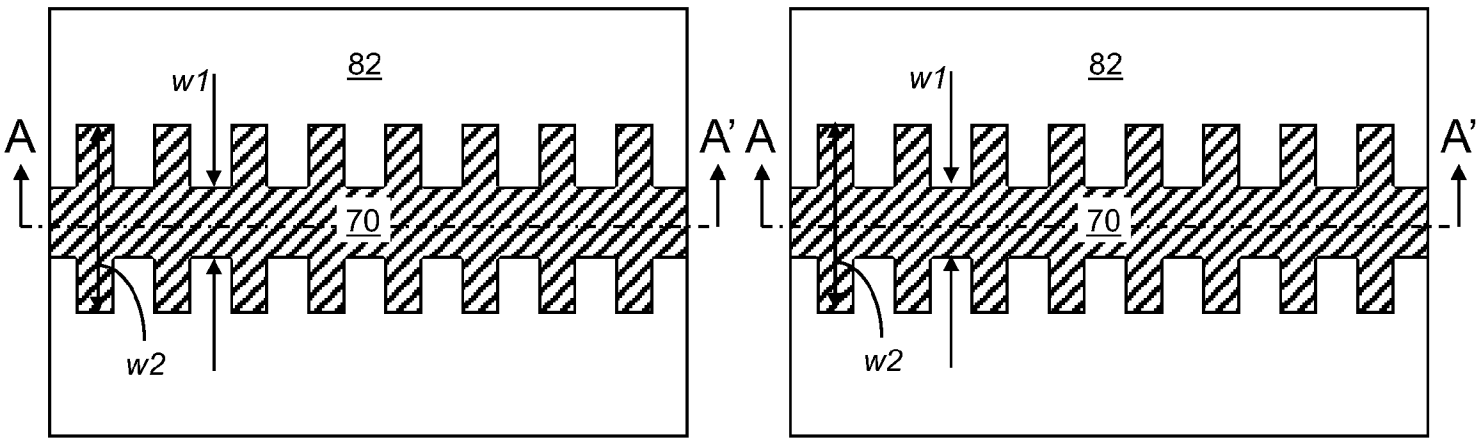
FIG. 7B
FIG. 8B

MILLIMETER WAVE TRANSMISSION LINE FOR SLOW PHASE VELOCITY

BACKGROUND OF THE INVENTION

The present invention relates to a semiconductor structure, and particularly to a transmission line structure providing a reduced phase velocity for a radio frequency signal such as a millimeter wave, a design structure for the same, and methods for operating the same.

Millimeter waves refer to electromagnetic radiation having a wavelength range from about 1 mm to about 10 mm. The corresponding frequency range for millimeter waves is from about 30 GHz to about 300 GHz. The wavelength range for the millimeter waves occupies the highest frequency range for microwaves, and is also referred to as extremely high frequency (EHF). The frequency range for the millimeter waves is the highest radio frequency band, and the electromagnetic radiation having a higher frequency than the millimeter waves is considered to be a far end (a long end) of the infrared radiation.

Millimeter waves display frequency-dependent atmospheric absorption due to oxygen and water vapor. The absorption coefficient for oxygen in atmosphere ranges from about 0.01 dB/km to about 10 dB/km, and the absorption coefficient for water vapor in atmosphere ranges from about 0.03 dB/km to about 30 dB/km. Due to the atmospheric absorption, the strength of a millimeter wave signal decreases more with distance than radio frequency signals at lower frequency.

While attenuation characteristics of millimeter waves limit the range of signal communication, the rapid signal attenuation with distance of the millimeter wave also enables frequency reuses. In other words, an array of millimeter wave signal transmitters may share the same frequency range for a subset of millimeter wave signal transmitters that are separated from each other by a sufficient distance. For this reason, millimeter waves are employed for short range radio communication including cellular phone applications.

Due to the short wavelength of the millimeter waves, manipulation of millimeter waves such as phase modulation poses a challenge in semiconductor devices.

BRIEF SUMMARY OF THE INVENTION

The present invention provides a semiconductor structure including a millimeter wave transmission line structure that provides reduced phase velocity for an electromagnetic signal, a design structure for the same, and methods of operating the same.

In the present invention, a grounding plate and a transmission line are provided in a stack of dielectric material layers. First transmission line portions having a first width are alternately interlaced with second transmission line portions having a second width in the transmission line. The second width is greater than the first width so that inductance of the transmission line is increased relative to a transmission line having a fixed width. Metal fins may be provided between the grounding plate and the transmission line portions with larger width in the stack of the dielectric material layers. Lengthwise directions of the metal fins are perpendicular to the lengthwise direction of the transmission line. The metal fins may be grounded to the grounding plate to increase capacitance between the transmission line and the grounding plate. The increase in the self-inductance and the capacitance between the transmission line and the grounding plate is advantageously employed to provide a reduced phase velocity for electromagnetic signal transmitted through the transmission line.

According to an aspect of the present invention, a structure is provided, which comprises: at least one dielectric material layer located on a substrate; a metallic transmission line embedded in the at least one dielectric material layer and including first transmission line portions having a first width and second transmission line portions having a second width, wherein the first width and the second width are different, and wherein the first transmission line portions and the second transmission line portions are alternately interlaced; and a grounding metal plane located in the at least one dielectric material layer and vertically separated from the metallic transmission line.

According to another aspect of the present invention, a method of operating a metallic transmission line structure is provided. The method comprises: providing a metal transmission line structure including: at least one dielectric material layer located on a substrate; a metallic transmission line embedded in the at least one dielectric material layer and including first transmission line portions having a first width and second transmission line portions having a second width, wherein the first width and the second width are different, and wherein the first transmission line portions and the second transmission line portions are alternately interlaced; and a grounding metal plane located in the at least one dielectric material layer and vertically separated from the metallic transmission line; electrically grounding the grounding metal plane; and applying a radio frequency (RF) signal across a first end of the metallic transmission line and the grounding metal plane.

According to yet another aspect of the present invention, a design structure for a transmission line structure is provided. The design structure includes data for a grounding plate, a transmission line, and a stack of dielectric material layers. First transmission line portions having a first width are alternately interlaced with second transmission line portions having a second width in the transmission line. The second width is greater than the first width so that inductance of the transmission line is increased relative to a transmission line having a fixed width. Metal fins may be provided between the grounding plate and the transmission line in the stack of the dielectric material layers. Lengthwise directions of the metal fins are perpendicular to the lengthwise direction of the transmission line. The metal fins may be grounded to the grounding plate to increase capacitance between the transmission line and the grounding plate. The increase in the self-inductance and the capacitance between the transmission line and the grounding plate is advantageously employed to provide a reduced phase velocity for electromagnetic signal transmitted through the transmission line. The design structure enables design of a transmission line structure that provides reduced phase velocity relative to a transmission line structures including a transmission line having a constant width.

According to still another aspect of the present invention, a design structure embodied in a machine readable medium for designing, manufacturing, or testing a design for a semiconductor chip is provided. The design structure comprises: a first data representing at least one dielectric material layer; a second data representing a metallic transmission line embedded in said at least one dielectric material layer and including a third data representing first transmission line portions having a first width and a fourth data representing second transmission line portions having a second width, wherein said first width and said second width are different, and wherein said first transmission line portions and said second transmission line portions are alternately interlaced; and a fifth data representing a grounding metal plane located in said at least one dielectric material layer and vertically separated from said metallic transmission line.

BRIEF DESCRIPTION OF THE SEVERAL VIEWS OF THE DRAWINGS

FIG. 1A is a vertical cross-sectional view along the plane A-A' in FIG. 1B. FIG. 1B is a top-down view. FIGS. 1C and 1D are vertical cross-sectional views of the first exemplary semiconductor structure along the plane C-C' or D-D', respectively, of FIG. 1A according to the present invention.

FIG. 2A is a vertical cross-sectional view along the plane A-A' in FIG. 2B. FIG. 2B is a top-down view. FIGS. 2C and 2D are vertical cross-sectional views of the first exemplary semiconductor structure along the plane C-C' or D-D', respectively, of FIG. 2A according to the present invention.

FIG. 3A is a vertical cross-sectional view along the plane A-A' in FIG. 3B. FIG. 3B is a horizontal cross-sectional view along the plane B-B' in FIG. 3A. FIGS. 3C and 3D are vertical cross-sectional views of the first exemplary semiconductor structure along the plane C-C' or D-D', respectively, of FIG. 3A. FIGS. 3E and 3F are horizontal cross-sectional view along the plane E-E' or F-F' in FIG. 3A according to the present invention.

FIG. 4A is a vertical cross-sectional view along the plane A-A' in FIG. 4B. FIG. 4B is a horizontal cross-sectional view along the plane B-B' in FIG. 4A. FIGS. 4C and 4D are vertical cross-sectional views of the first exemplary semiconductor structure along the plane C-C' or D-D', respectively, of FIG. 4A. FIGS. 4E and 4F are horizontal cross-sectional view along the plane E-E' or F-F' in FIG. 4A according to the present invention.

FIG. 5A is a vertical cross-sectional view along the plane A-A' in FIG. 5B. FIG. 5B is a horizontal cross-sectional view along the plane B-B' in FIG. 5A.

FIG. 6A is a vertical cross-sectional view along the plane A-A' in FIG. 6B. FIG. 6B is a horizontal cross-sectional view along the plane B-B' in FIG. 6A.

FIGS. 7A and 7B are views of a third exemplary semiconductor structure according to yet another embodiment of the present invention. FIG. 7A is a vertical cross-sectional view along the plane A-A' in FIG. 7B. FIG. 7B is a horizontal cross-sectional view along the plane B-B' in FIG. 7A.

FIGS. 8A and 8B are views of the first exemplary semiconductor structure according to the present invention. FIG. 8A is a vertical cross-sectional view along the plane A-A' in FIG. 8B. FIG. 8B is a horizontal cross-sectional view along the plane B-B' in FIG. 8A.

DETAILED DESCRIPTION OF THE INVENTION

Figure 1A:
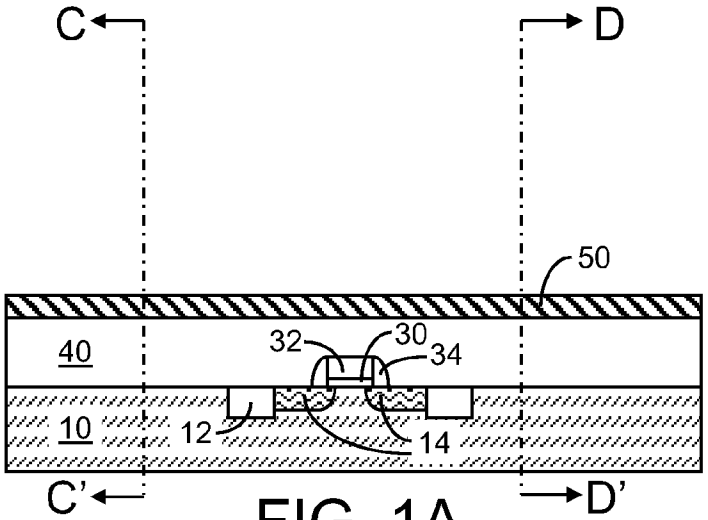
FIGS. 1A-1D, 2A-2D, 3A-3F, and 4A-4F are various views of a first exemplary semiconductor structure according to an embodiment of the present invention. Figures with the same numeric label correspond to the same stage of manufacturing.
Figure 1B:
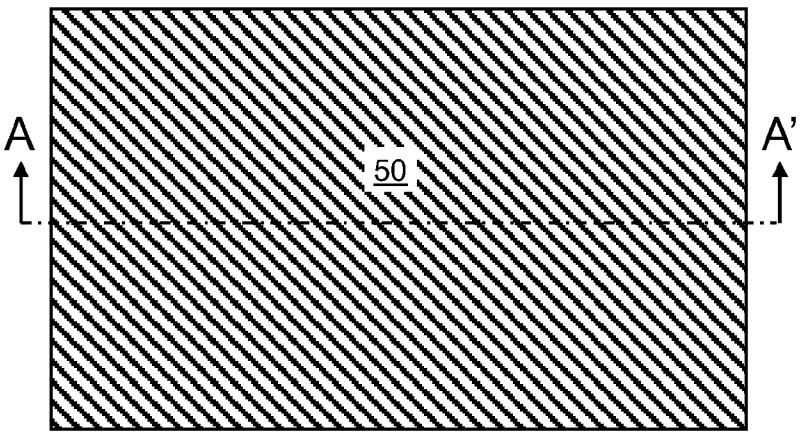
Figure 1C:
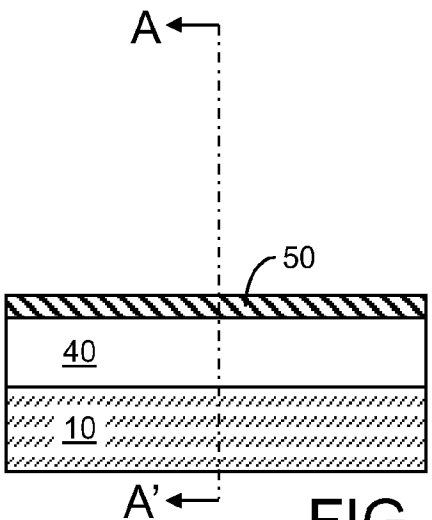
Figure 1D:
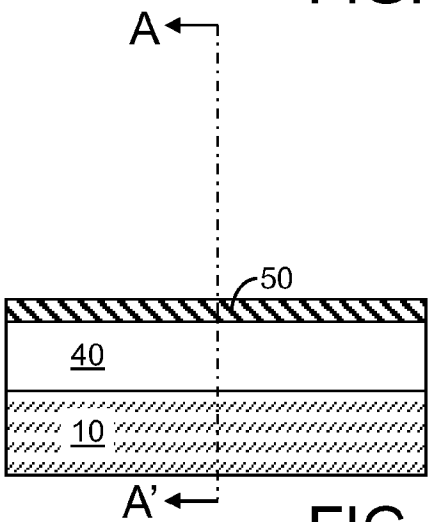
Figure 2A:
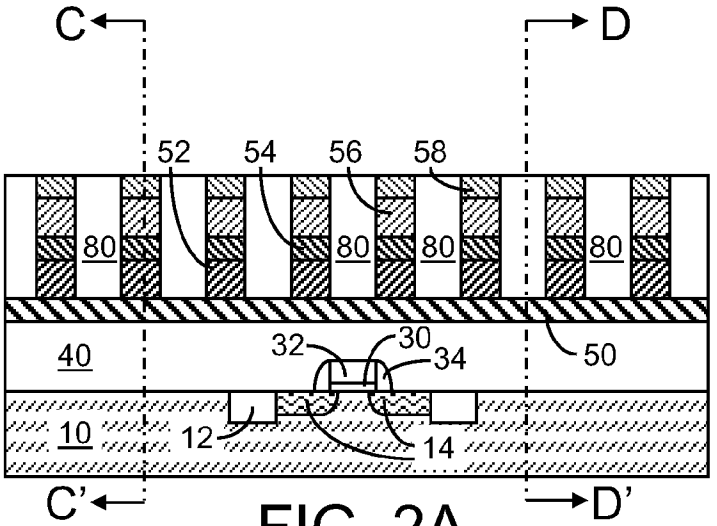
Figure 2B:
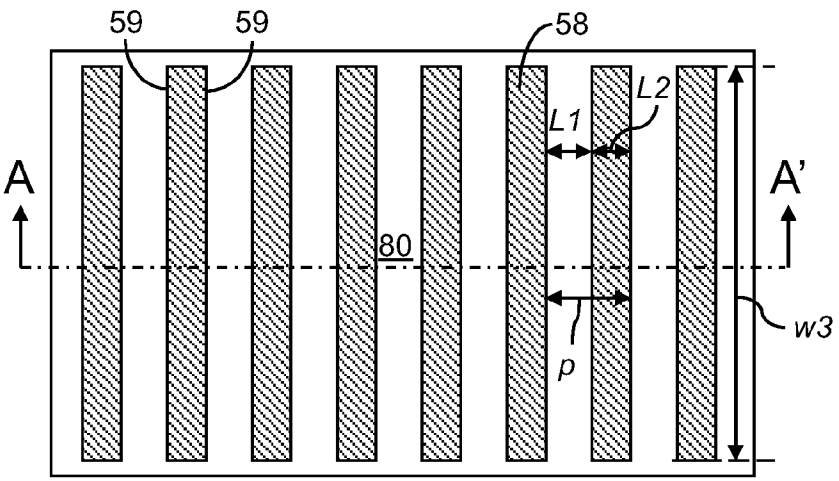
Figure 2C:
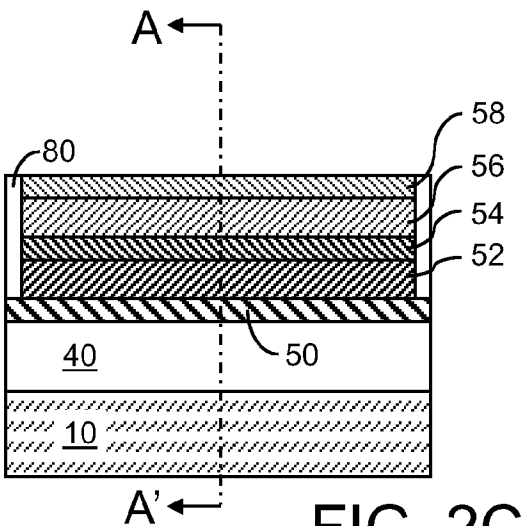
Figure 2D:
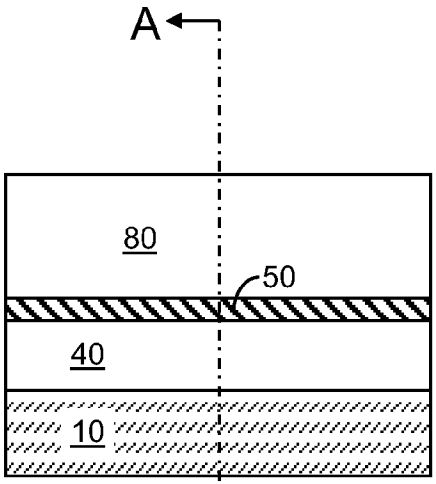

As stated above, the present invention relates to a transmission line structure providing a reduced phase velocity for radio frequency signal such as a millimeter wave, design structures for the same, and methods of operating the same. The drawings are not necessarily drawn to scale.

Referring to FIGS. 1A-1D, a first exemplary semiconductor structure according to a first embodiment of the present invention comprises a substrate 10, at least one first dielectric material layer 40, and a grounding metal plane 50. The substrate 10 may be a semiconductor substrate in which at least one semiconductor device is embedded. For example, the at least one semiconductor device may include a field effect transistor comprising source and drain regions 14, a gate dielectric 30, a gate conductor 32, and a gate spacer 34. Shallow trench isolation structures 12 comprising a dielectric material may be formed in the semiconductor substrate.

The semiconductor substrate comprises a semiconductor material such as silicon, a silicon germanium alloy region, silicon, germanium, a silicon-germanium alloy region, a silicon carbon alloy region, a silicon-germanium-carbon alloy region, gallium arsenide, indium arsenide, indium gallium arsenide, indium phosphide, lead sulfide, other III-V compound semiconductor materials, and II-VI compound semiconductor materials. The semiconductor substrate may be a single crystalline semiconductor substrate. For example, the single crystalline semiconductor substrate may be a single crystalline silicon substrate.

The at least one first dielectric material layer 40 may include a middle-of-line (MOL) dielectric material layer and/or at least one back-end-of-line (BEOL) dielectric material layer. The dielectric materials that may be used for the at least one first dielectric material layer 40 include, but are not limited to, a silicate glass, an organosilicate glass (OSG) material, a SiCOH-based low-k material formed by chemical vapor deposition, a spin-on glass (SOG), or a spin-on low-k dielectric material such as SiLK™, etc. The silicate glass includes an undoped silicate glass (USG), borosilicate glass (BSG), phosphosilicate glass (PSG), fluorosilicate glass (FSG), borophosphosilicate glass (BPSG), etc. The dielectric material may be a low dielectric constant (low-k) material having a dielectric constant less than 3.0. The dielectric material may be non-porous or porous. The total thickness of the at least one dielectric material layer 40 may be from 0.1 μm to 20 μm, and typically from 0.2 μm to 2 μm, although lesser and greater thicknesses are also contemplated herein.

The grounding metal plane 50 comprises a metallic material such as Cu, Ni, Au, W, Au, Ag, Ta, Ti, TaN, TiN, and WN. Preferably, the grounding metal plane 50 comprises an electroplatable material such as Cu or Ni or a sputter deposited material such as Al. The grounding metal plane 50 may be formed in the same level as a line-level metal interconnect structure or a via-level metal interconnect structure. In other words, a line-level metal interconnect structure such as a metal line or a via-level metal interconnect structure such as a metal via may be formed at the same level as the grounding metal plane 50 employing the same processing steps. The thickness of the grounding metal plane 50 may be the same as the thickness of a line-level metal interconnect structure or a via-level metal interconnect structure, and may be from 50 nm to 2,000 nm, and typically from 100 nm to 500 nm, although lesser and greater thicknesses are also contemplated herein.

The grounding metal plane 50 is connected to a structure that functions as an electrical ground. Alternately or in addition, the electrical ground of semiconductor devices on the semiconductor substrate may be connected to the grounding metal plane 50. Typically, the electrical connection for grounding purposes is effected by a low resistance conductive path between the grounding metal plane 50 and the electrical ground of the semiconductor devices.

Referring to FIGS. 2A-2D, at least one second dielectric material layer 80 and an array of metallic fins are formed on the grounding metal plane 50. Each second dielectric material layer in the at least one second dielectric material layer 80 may comprise any of the material that may be employed as the at least one first dielectric material layer 40 as discussed above. Each metallic fin in the array of metallic fins comprises at least one metallic fin portion. In case the at least one metallic fin portion comprises multiple metallic fin portions, the at least one metallic fin portion may be formed in vertically adjoining layers and vertically abut one another.

For example, each metallic fin may include a first metallic fin portion 52, a second metallic fin portion 54, a third metallic fin portion 56, and a fourth metallic fin portion 58. A metallic fin (52, 54, 56, 58) may vertically abut the top surface of the grounding metal plane 50, or may not abut the top surface of the grounding metal plane 50, i.e., may be located above the top surface of the grounding metal plane 50. The at least one second dielectric material layer may include a single dielectric material layer or a plurality of dielectric material layers, in which the first through fourth metal fin portions (52, 54, 56, 58) are embedded.

Each metallic fin portion may be embedded within different dielectric material layers corresponding to different metal interconnect levels. For example, the grounding metal plane 50 may be formed in a first line-level metal interconnect layer, the first metallic fin portions 52 may be formed in a first via-level metal interconnect layer, the second metallic fin portions 54 may be formed in a second line-level metal interconnect layer, the third metallic fin portions 56 may be formed in a second via-level metal interconnect layer, and the fourth metallic fin portions 58 may be formed in a third line-level metal interconnect layer. Alternately, the grounding metal plane 50 may be formed in a first via-level metal interconnect layer, the first metallic fin portions 52 may be formed in a first line-level metal interconnect layer, the second metallic fin portions 54 may be formed in a second via-level metal interconnect layer, the third metallic fin portions 56 may be formed in a second line-level metal interconnect layer, and the fourth metallic fin portions 58 may be formed in a third via-level metal interconnect layer. Yet alternately, each of the first through fourth metallic fin portion (52, 54, 56, or 58) may be formed in an integrated level metal interconnect layer in which integrated line and via structures are formed. The various metallic fin portions (52, 54, 56, 58) may thus be line-level metal interconnect portions, via-level metal interconnect portions, and/or line-and-via-level metal interconnect portions. The thickness of each of the various metallic fin portions (52, 54, 56, 58) may be the same as the thickness of a line-level metal interconnect layer, the thickness of a via-level metal interconnect layer, or the thickness of an integrated line-and-via-level metal interconnect layer.

The various metallic fin portions (52, 54, 56, 58) may comprise a metallic material such as Cu, Ni, Au, W, Au, Ag, Ta, Ti, TaN, TiN, and WN. Preferably, the various metallic fin portions (52, 54, 56, 58) comprise an electroplatable material such as Cu or Ni or a sputter deposited material such as Al. The thickness of each of the various metallic fin portions (52, 54, 56, 58) may be from 50 nm to 2,000 nm, and typically from 100 nm to 500 nm, although lesser and greater thicknesses are also contemplated herein.

The use of first through fourth metallic fin portions (52, 54, 56, 58) are only for the purpose of providing an example of implementation of the present invention. Other embodiments employing any number of different levels of metallic fin portions are explicitly contemplated herein. The number of different levels of metallic fins is a positive integer that may be 1 or a number greater than 1. As discusses above, each metallic fin (52, 54, 56, 58) may, or may not, abut the top surface of the grounding metal plane 50. If the metallic fins (52, 54, 56, 58) do not abut the top surface of the grounding metal plate 50, the array of the metallic fins (52, 54, 56, 58) may be electrically floating. If the metallic fins (52, 54, 56, 58) abut the top surface of the grounding metal plate 50, the array of the metallic fins (52, 54, 56, 58) may be grounded through a resistive connection to the grounding metal plate 50.

Each metallic fin may have substantially vertically coincident sidewalls with the various metallic fin portions (52, 54, 56, 58). Preferably, the array of the metallic fins (52, 54, 56, 58) is a regular one-dimensional array of a first unit structure in which each metallic fin (52, 54, 56, 58) functions as the first unit structure. In other words, each metallic fin (52, 54, 56, 58) has an identical shape, and is placed at a regular interval along a direction, which is herein referred to as a lengthwise direction. The periodicity of the array of the metallic fins (52, 54, 56, 58) in the lengthwise direction is herein referred to as an array pitch p.

Each metallic fin (52, 53, 56, 58) may have a rectangular horizontal cross-sectional shape. The dimension of the sides of the rectangular shape in the lengthwise direction is herein referred to as a second length L2. The dimension of the sides of the rectangular shape in a widthwise direction is herein referred to as a third width w3. The widthwise direction is perpendicular to the lengthwise direction. The distance between an adjacent pair of metallic fins (52, 54, 56, 58) is herein referred to a first length L1. The array pitch p is equal to the sum of the first length L1 and the second length L2.

In case the horizontal cross-sectional area of a metallic fin (52, 54, 56, 58) is rectangular, each metallic fin (52, 54, 56, 58) in the array has a pair of widthwise sidewalls 59 that are perpendicular to the lengthwise direction, which is the direction of the first length L1, the second length L2, and the array pitch p.

Referring to FIGS. 3A-3F, at least one third dielectric material layer 82, a metallic transmission line 70, and at least one fourth dielectric material layer 84 are sequentially formed above the array of the metallic fins (52, 54, 56, 58) and the at least one second dielectric material layer 80. Each dielectric material layer in the at least one third dielectric material layer 82 and the at least one fourth dielectric material layer 84 may comprise any of the material that may be employed as the at least one first dielectric material layer 40 as discussed above. The thickness of the at least one third dielectric material layer 82 may be from 50 nm to 2,000 nm, and typically from 100 nm to 300 nm, although lesser and greater thicknesses are also contemplated herein. The thickness of the at least one fourth dielectric material layer 84 may be from 50 nm to 10 μm, although lesser and greater thicknesses are also contemplated herein.

The metallic transmission line 70 may be formed by a damascene method, which patterned a line trench in the topmost layer of the at least one third dielectric material layer 82 and filling the line trench with a metallic material, followed by planarization that forms the metallic transmission line 70 in the line trench. In this case, the top surface of the metallic transmission line 70 may be substantially coplanar with the top surface of the at least one third dielectric material layer 82 and the bottom surface of the at least one fourth dielectric material layer 84. Preferably, the entirety of the top surface of the metallic transmission line 70 is substantially planar, and the entirety of the bottom surface of the metallic transmission line 70 is substantially planar.

Alternately, the metallic transmission line 70 may be formed by a blanket deposition of a metallic layer on a planar surface, which may be the top surface of the at least one third dielectric material layer 80 that does not include any line trench, and a subsequent lithographic patterning of the blanket metallic layer. In this case, the bottom surface of the metallic transmission line 70 may be substantially coplanar with the top surface of the at least one third dielectric material layer 82 and the bottom surface of the at least one fourth dielectric material layer 84. Preferably, the entirety of the top surface of the metallic transmission line 70 is substantially planar, and the entirety of the bottom surface of the metallic transmission line 70 is substantially planar.

The bottom surface of the grounding metal plane 50, the top surface of the grounding metal plane 50, the bottom surface of the metallic fins (52, 54, 56, 58), the top surface of the metallic fins (52, 54, 56, 58), the bottom surface of the metallic transmission line 70, and the top surface of the metallic transmission line 70 may be substantially horizontal and parallel among one another. The interface between the substrate 10 and the at least one first dielectric material layer 40 may be substantially horizontal and parallel to the bottom surface of the grounding metal plane 50.

Figure 3A:
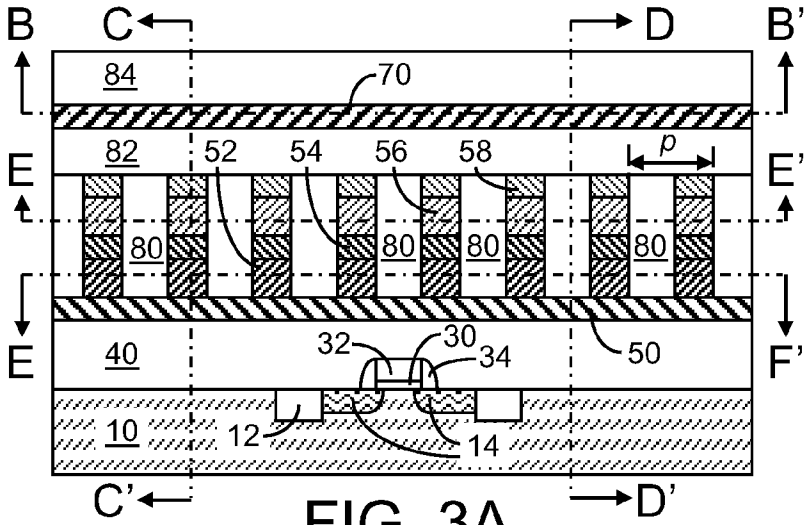
Figure 3B:
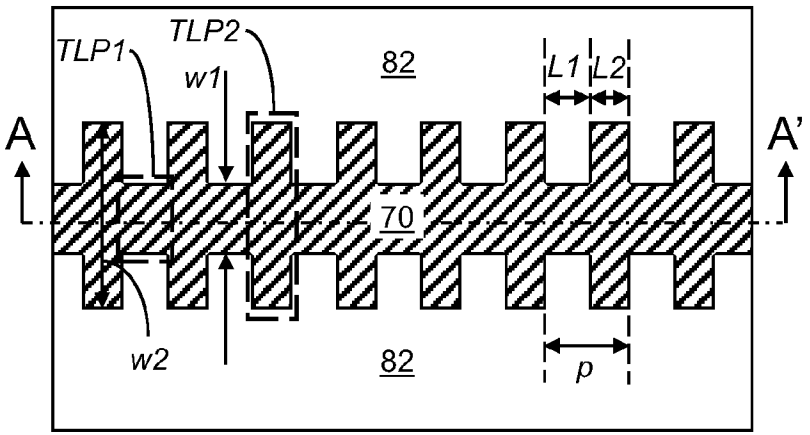
Figure 3C:
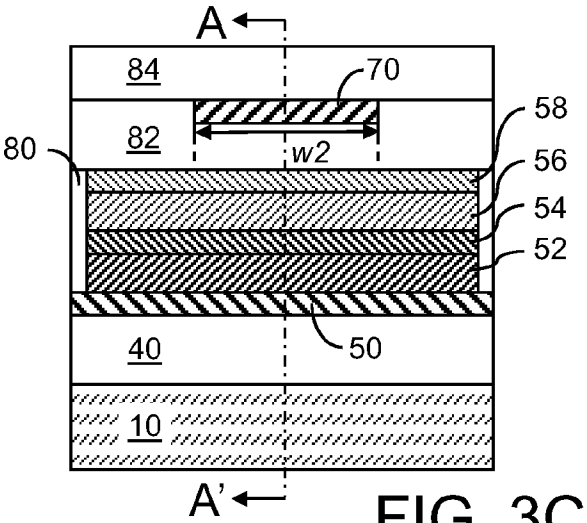
Figure 3D:
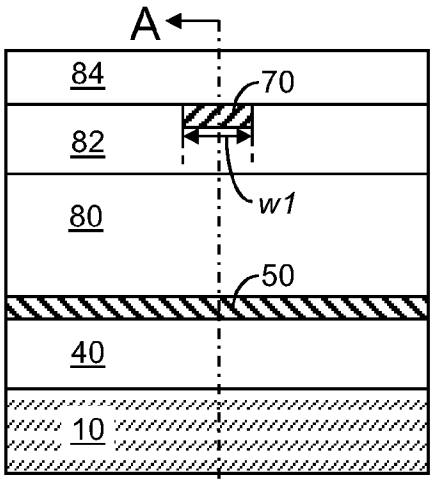
Figure 3E:
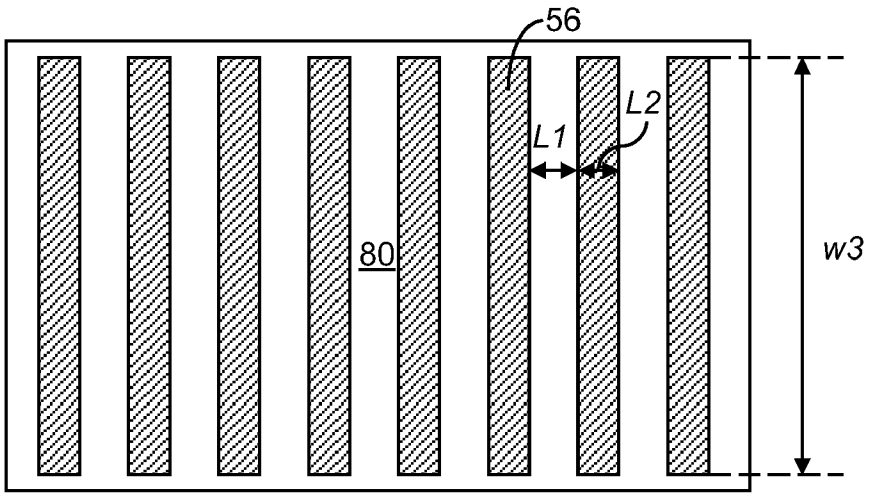
Figure 3F:
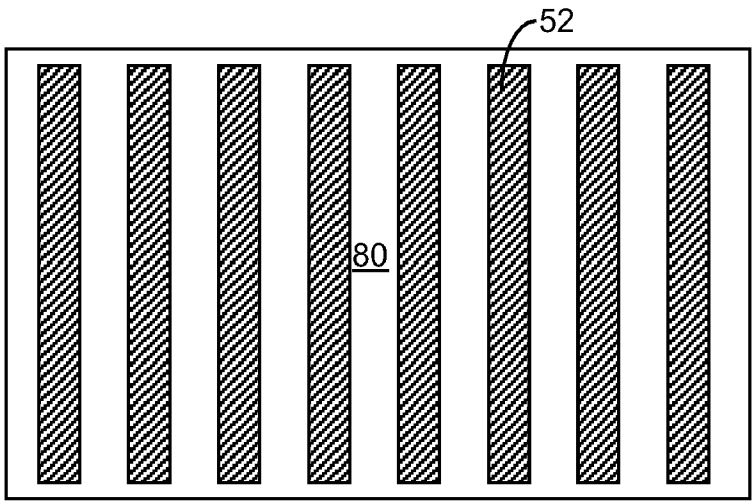
Figure 4A:
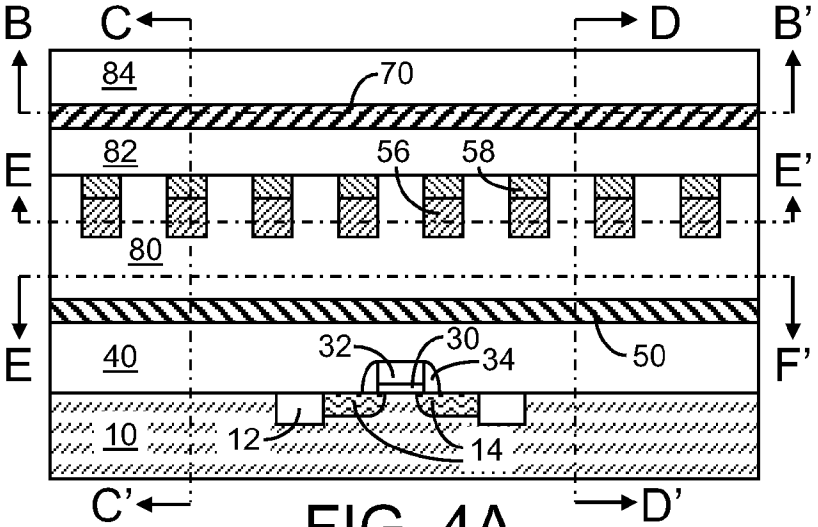
Figure 4B:
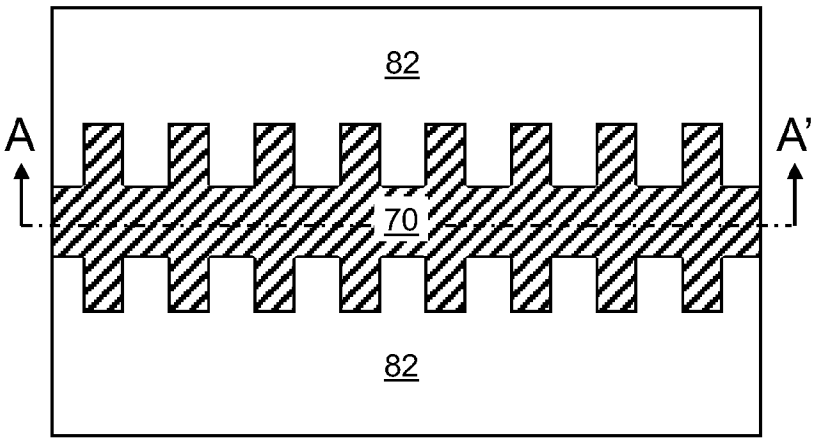
Figure 4C:
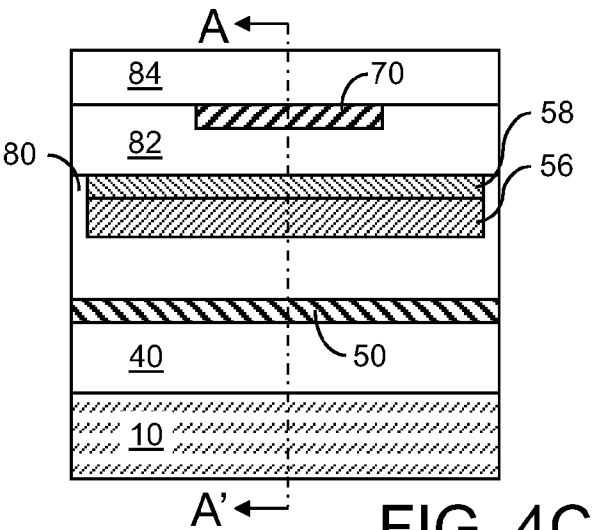
Figure 4D:
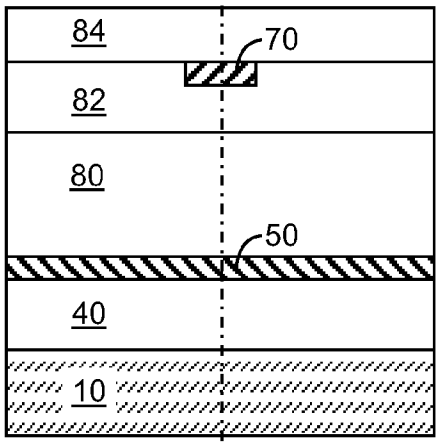
Figure 4E:
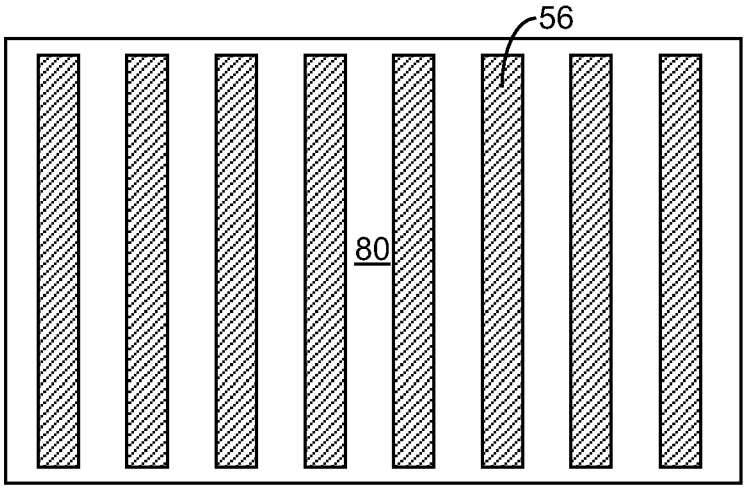
Figure 4F:
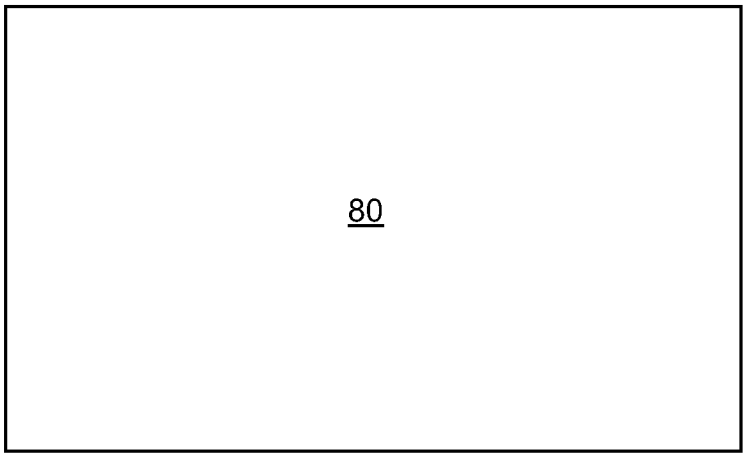

The pattern of the metallic transmission line 70 is shown in FIG. 3B, which is a horizontal cross-sectional view along the plane B-B' in FIG. 3A. Preferably, the metallic transmission line 70 comprises a one-dimensional periodic array of a unit structure, which is herein referred to as a second unit structure. The second unit structure comprises a first transmission line portion TLP1 and a second transmission line portion TLP2. Preferably, the length, or the dimension along the lengthwise direction, of the first transmission line portion TLP1 is substantially the same as the first length L1, which is the distance between an adjacent pair of metallic fins (52, 54, 56, 58). Preferably, the length of the second transmission line portion TLP2 is substantially the same as the second length L2, which is the dimension of a metallic fin (52, 54, 56, 58) along the lengthwise direction. Since the second unit structure consists of a first transmission line portion TLP1 and a second transmission line portion TLP2, the pitch of the one-dimensional array of the second unit structure is the same as the sum of the first length L1 and the second length L2, or the array pitch p, which is the pitch of the array of the metallic fins (52, 54, 56, 58).

Each first transmission line portion TLP1 overlies the at least one second dielectric material layer 80, but does not overlie the metallic fins (52, 54, 56, 58). Each second transmission line portion TLP2 overlies a metallic fins (52, 54, 56, 58), but does not overlie the at least one second dielectric material layer 80.

Each first transmission line portion TLP1 may have a first horizontal cross-sectional area in a first shape of a first rectangle, in which two sides in the widthwise direction have a dimension of a first width w1, and two other sides in the lengthwise direction have a dimension of the first length L1. Each second transmission line portion TLP2 may have a second horizontal cross-sectional area in a second shape of a second rectangle, in which two sides in the widthwise direction have a dimension of a second width w2, and two other sides in the lengthwise direction have a dimension of the second length L2. The widthwise direction is a horizontal direction that is perpendicular to the lengthwise direction. The second width w2 is greater than the first width w1. The first width w1 may be from 0.1 μm to 30 μm, and the second width may be from 0.2 μm to 100 μm, and the array pitch p may be from 0.3 μm to 200 μm. The ratio of the second width w2 to the first width w1 may be from 1.1 to 100, and typically from 2 to 10, although lesser and greater ratios are also contemplated herein.

The sidewalls of the first transmission line portions TLP1 that are parallel to the lengthwise direction are herein referred to as first lengthwise sidewalls. A pair of first lengthwise sidewalls within the same first transmission line portion TLP1 is separated by the first width w1. Each first lengthwise sidewall laterally extends the distance of the first length L1. The sidewalls of the second transmission line portions TLP2 that are parallel to the lengthwise direction are herein referred to as second lengthwise sidewalls. A pair of second lengthwise sidewalls within the same second transmission line portion TLP2 is separated by the second width w2. Each second lengthwise sidewall laterally extends the distance of the second length L2.

The metallic transmission line 70 comprises a one-dimensional repetition of the second unit structure, which consists of a first transmission line portion TLP1 and a second transmission line portion TLP2 that laterally abut each other. Since the second unit structures (TLP1, TLP2) are repeated in the lengthwise direction, the first transmission line portions TLP1 and the second transmission line portions TLP2 are alternately interlaced within the metallic transmission line 70. Each first transmission line portion TLP1 that is not located at an end of said metallic transmission line 70 is laterally abutted by two second transmission line portions TLP2. Likewise, each second transmission line portion TLP2 that is not located at an end of the metallic transmission line 70 is laterally abutted by two first transmission line portions TLP1.

As implemented within the metallic transmission line, each second unit structure (TLP1, TLP2) includes a pair of first lengthwise sidewalls separated by the first width w1, a pair of second lengthwise sidewalls separated by the second width w2, and two pairs of widthwise sidewalls that are perpendicular to the lengthwise direction. Each pair of widthwise sidewalls is directly adjoined to a second lengthwise sidewall. The first lengthwise sidewalls, the second lengthwise sidewalls, and the widthwise sidewalls may be substantially vertical, and laterally abuts one of the at least one second dielectric material layer 80 or the at least one third dielectric material layer 82. Preferably, the third width w3, which is the width of the metallic fins (52, 54, 56, 58), is greater than the second width w2 and the first width w1.

The metallic transmission line 70 overlies the grounding metal plate 50. While the present invention is described with a metallic transmission line 70 that overlies the grounding metal plate 50, a derived structure in which a metallic transmission line underlies a grounding metal plate is explicitly contemplated. In the derived structure, all structural elements between the at least one first dielectric material layer 40 and the at least one fourth dielectric material layer 84 are flipped upside down collectively. The derived structure may be obtained by forming the metallic transmission line 70 directly on the at least one dielectric material layer 40, followed by formation of the at least one third dielectric material layer 82, then followed by formation of metallic fins (52, 54, 56, 58) and the at least one second dielectric material layer 80, then followed by formation of the grounding metal plane 50, and then followed by formation of the at least one fourth dielectric material layer 84. In this case, the metallic fins overlie the second transmission line portion TLP2, but do not overlie the first transmission line portion TLP1.

The vertical overlap of the second transmission line portion TLP2 and the metallic fins (52, 54, 56, 58) increase the capacitance between the metallic transmission line 70 and the grounding metal plate 50. The variations in the width of the second transmission line Referring to FIGS. 4A-4F, a second exemplary semiconductor structure according to a second embodiment of the present invention is shown. The second exemplary semiconductor structure may be derived from the first exemplary semiconductor structure of FIGS. 1A-1D by following the processing steps of the first embodiment with the modification that the first metallic fin portions 52 and the second metallic fin portions 54 are not formed. In general any number of metallic fin portions may be present between the grounding metal plate 50 and the metallic transmission line 70. In the second embodiment, the metallic fins (56, 58) do not vertically abut the grounding metal plate 50 so that the metallic fins (56, 58) are electrically isolated from the grounding metal plate.

Figure 5A:
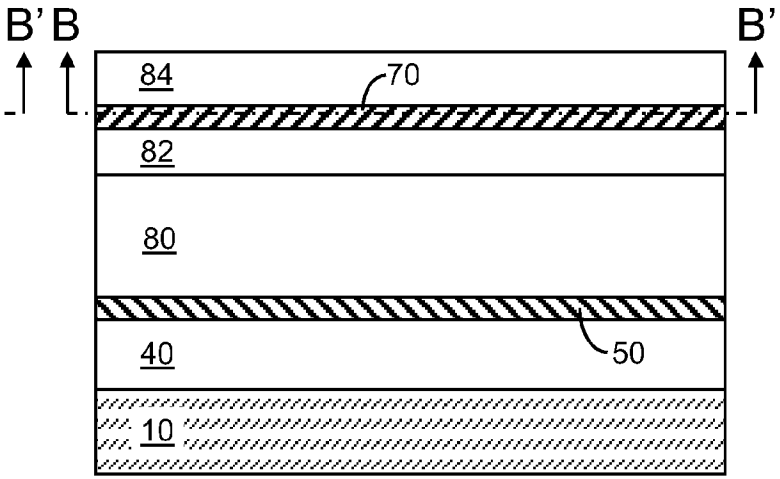
FIGS. 5A and 5B are views of a reference semiconductor structure for the purposes of comparing simulation results.
Figure 5B:
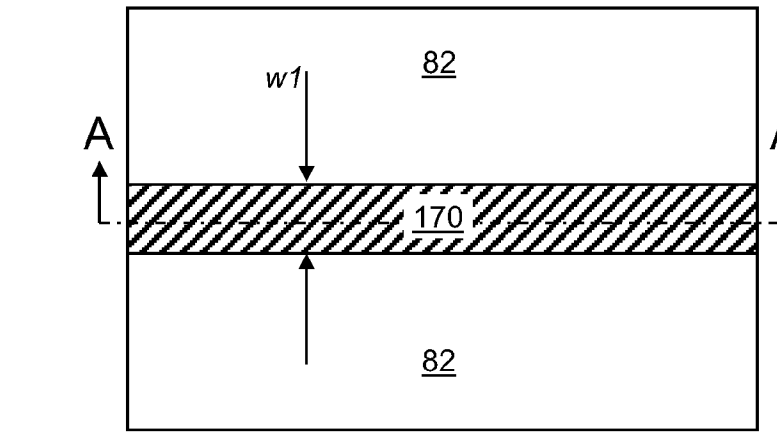

Referring to FIGS. 5A and 5B, a reference transmission line structure is provided for the purposes of comparing simulation results and illustrating the advantageous effects of the present invention. The reference semiconductor structure may be formed by omitting formation of semiconductor devices and the metallic fins (52, 54, 56, 58) in the first exemplary semiconductor structure and by forming a metallic transmission line 170 have straight lengthwise edges separated by the first width w1.

Figure 6A:
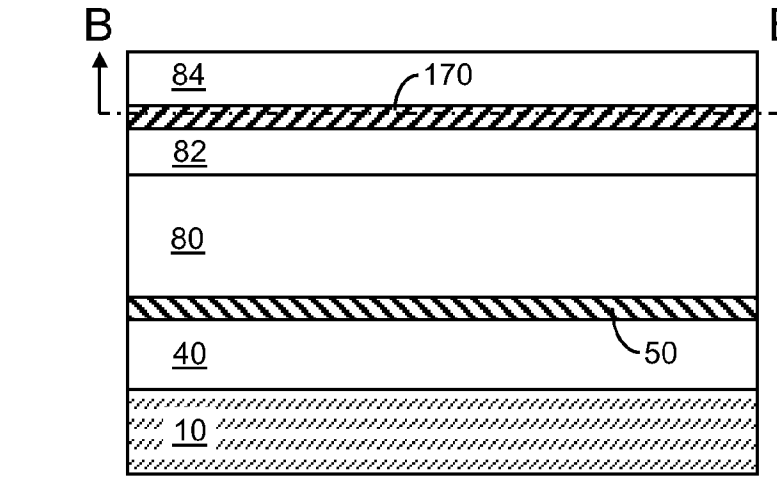
FIGS. 6A and 6B are views of a second exemplary semiconductor structure according to another embodiment of the present invention.
Figure 6B:
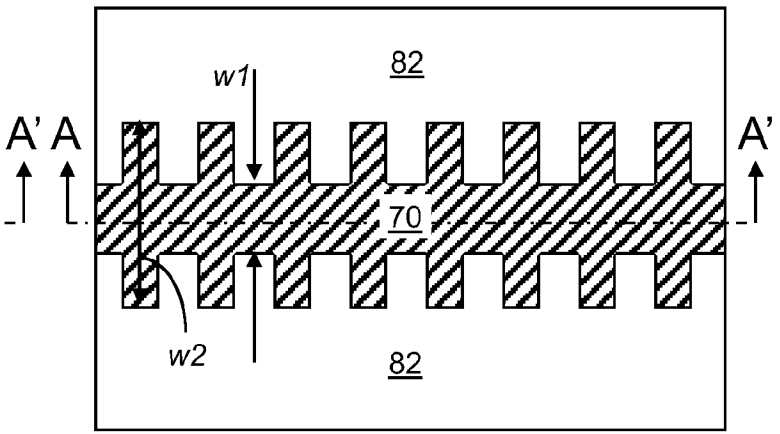

Referring to FIGS. 6A and 6B, a first exemplary transmission line structure is provided, which may be formed by omitting formation of semiconductor devices and the metallic fins (52, 54, 56, 58) during the processing steps employed to form the first exemplary semiconductor structure. The metal transmission line 70 of the first exemplary transmission line structure is the same as the metal transmission line 70 of the first and second exemplary semiconductor structures.

Referring to FIGS. 7A and 7B, a second exemplary transmission line structure is provided, which may be formed by omitting formation of semiconductor devices and lower components of metallic fins during the processing steps as in formation of the second exemplary semiconductor structure. The metal transmission line 70 of the second exemplary transmission line structure is the same as the metal transmission line 70 of the first and second exemplary semiconductor structures.

Referring to FIGS. 8A and 8B, a third exemplary transmission line structure is provided, which may be formed by omitting formation of semiconductor devices during the processing steps for the first exemplary semiconductor structure. The metal transmission line 70 of the third exemplary transmission line structure is the same as the metal transmission line 70 of the first and second exemplary semiconductor structures.

Figure 9:
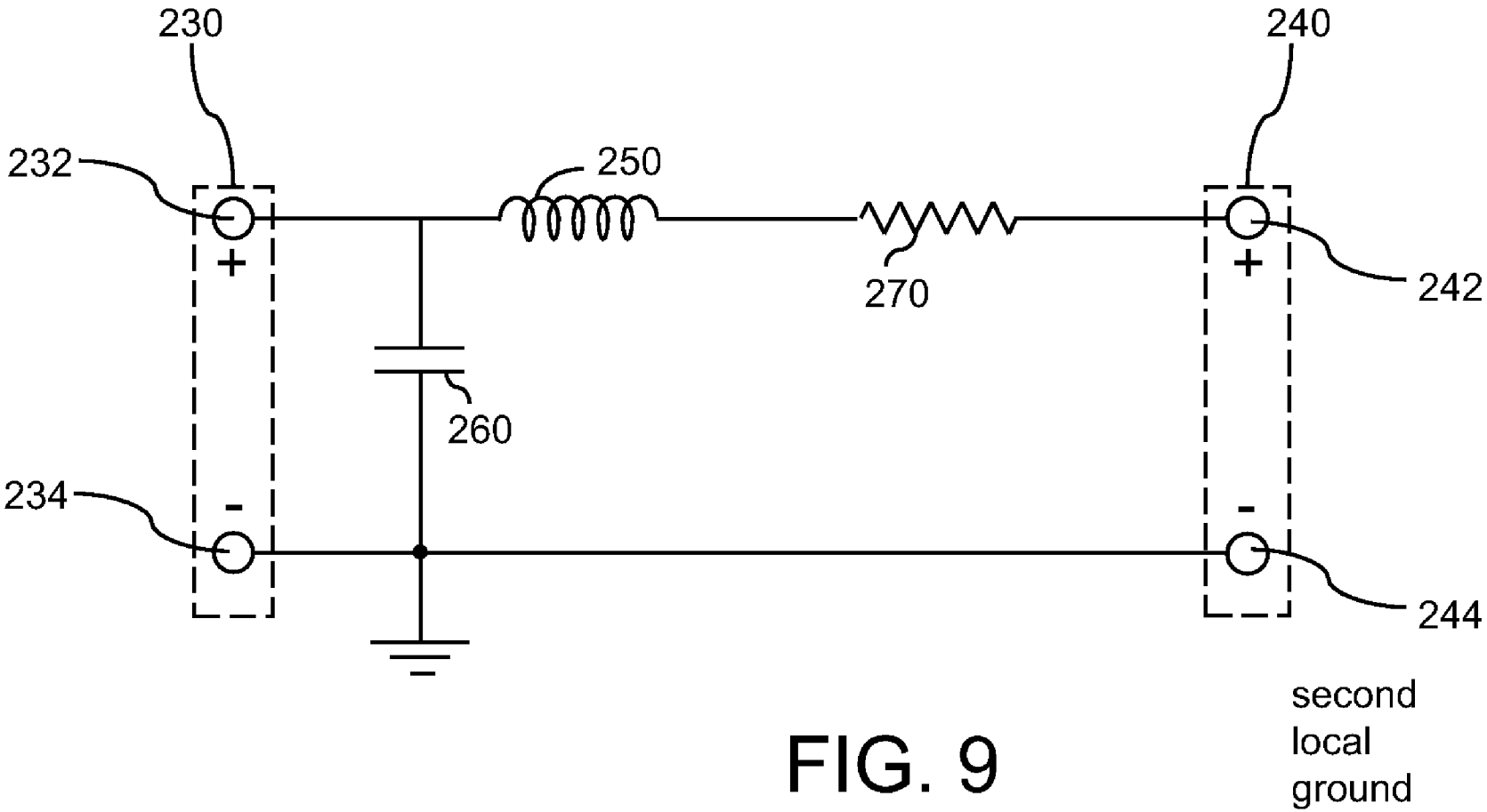
FIG. 9 is a circuit schematic for the reference semiconductor structure of FIGS. 5A and 5B, the second exemplary semiconductor structure of FIGS. 6A and 6B, the third exemplary semiconductor structure of FIGS. 7A and 7B, and the first exemplary semiconductor structure of FIGS. 8A and 8B.

Referring to FIG. 9, a circuit schematic is shown that is employed to model the behavior of high frequency radio signals including signals in the range of millimeter waves (30 GHz to 300 GHz) for the reference semiconductor structure of FIGS. 5A and 5B, the first exemplary transmission line structure of FIGS. 6A and 6B, the second exemplary transmission line structure of FIGS. 7A and 7B, and the third exemplary transmission line structure of FIGS. 8A and 8B. Each metallic transmission line is characterized by an inductor 250 having an inductance L and a resistor 270 having a resistance R. The metallic transmission line and the grounded metal plane 50 (See FIGS. 5A, 6A, 7A, and 8A) collectively form a capacitor 260 having a capacitance C. A first end of each metallic transmission line and the grounded metal plane 50 form an input node 230 of the transmission line structure that include a metallic transmission line, a grounded metal plane, and the dielectric material therebetween. The input node 230 includes a positive signal input node 232 and a negative grounding input node 234. A second end of each metallic transmission line and the grounded metal plane 50 form an output node 240 of the transmission line structure. The output node 240 includes a positive signal output node 242 and a negative grounding output node 244.

Figure 10:
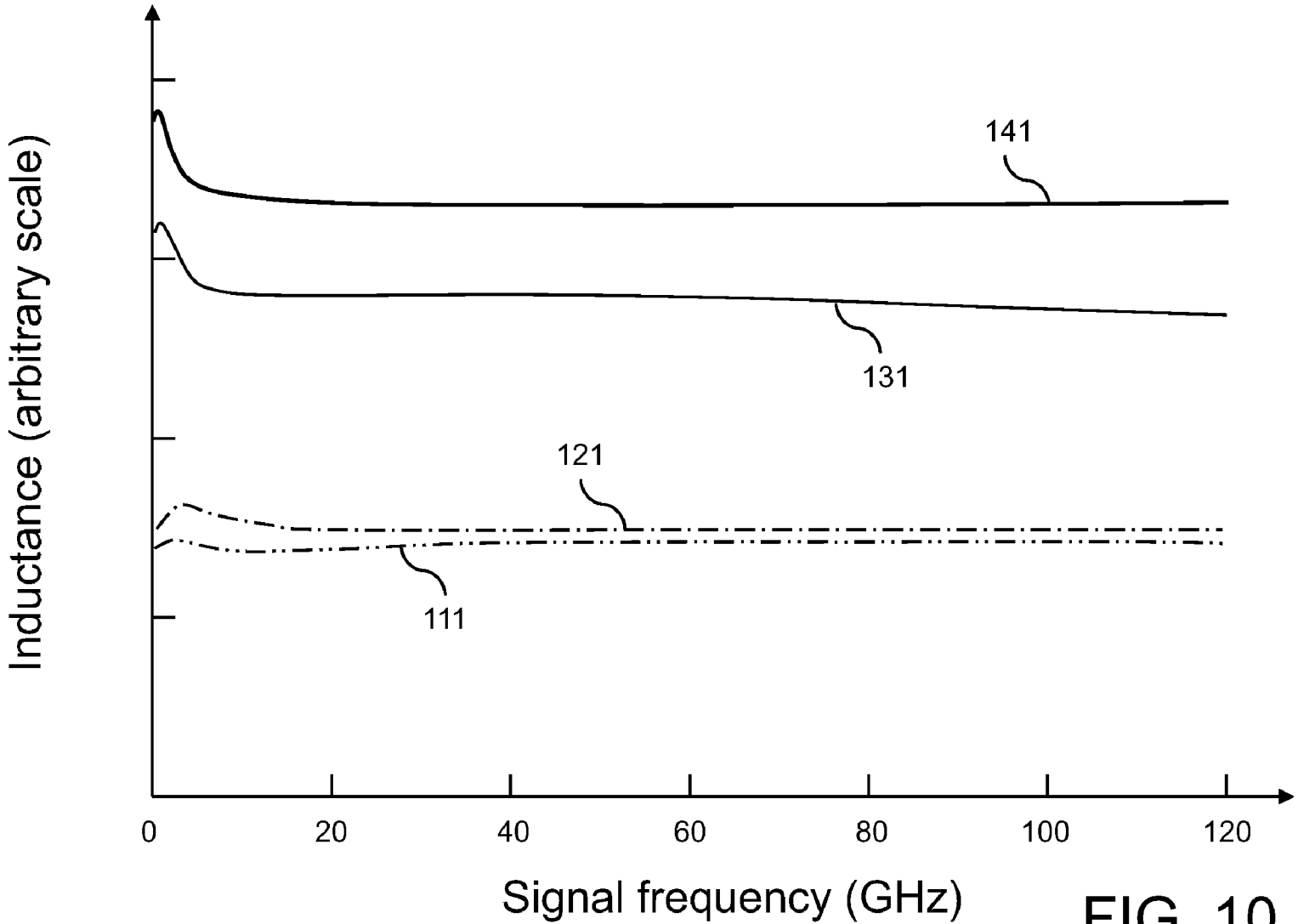
FIG. 10 is a graph of inductance as a function of signal frequency for the structures shown in FIGS. 5A and 5B, 6A and 6B, 7A and 7B, and 8A and 8B.
Figure 11:
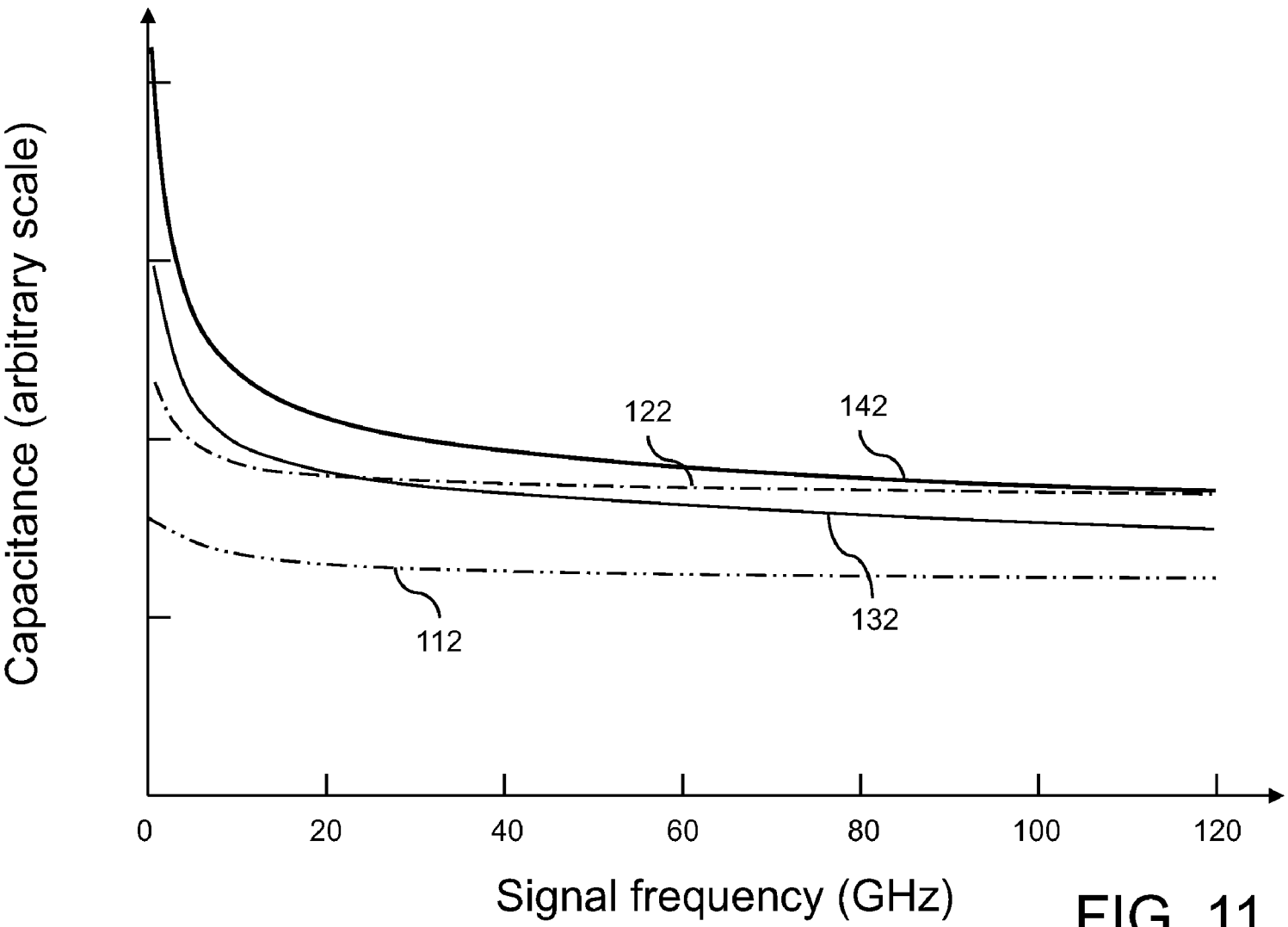
FIG. 11 is a graph of capacitance as a function of signal frequency for the structures shown in FIGS. 5A and 5B, 6A and 6B, 7A and 7B, and 8A and 8B.

FIG. 10 is a graph of inductance L as a function of signal frequency for the structures shown in FIGS. 5A and 5B, 6A and 6B, 7A and 7B, and 8A and 8B. The inductance of the reference transmission line structure in FIGS. 5A and 5B is represented by a reference inductance curve 111, the inductance of the first exemplary transmission line structure in FIGS. 6A and 6B is represented by a first inductance curve 121, the inductance of the second exemplary transmission line structure in FIGS. 7A and 7B is represented by a second inductance curve 131, and the inductance of the third exemplary transmission line structure in FIGS. 8A and 8B is represented by a third inductance curve 141. While the use of alternately interlaced transmission line portions in the first exemplary transmission line structure increases inductance over the reference transmission line components to a degree, the combination of the alternately interlaced transmission line portions with an array of metallic fins, as in the second and third exemplary transmission line structures, increases the inductance of transmission line structures significantly as demonstrated by the second and third inductance curves (131, 141). Grounding of the array of the metallic fins to a grounding metal plane as in the third exemplary metallic transmission line structure provides the most effective increase in the inductance of a metallic transmission line structure.

FIG. 10 is a graph of capacitance C as a function of signal frequency for the structures shown in FIGS. 5A and 5B, 6A and 6B, 7A and 7B, and 8A and 8B. The capacitance of the reference transmission line structure in FIGS. 5A and 5B is represented by a reference capacitance curve 112, the capacitance of the first exemplary transmission line structure in FIGS. 6A and 6B is represented by a first capacitance curve 122, the capacitance of the second exemplary transmission line structure in FIGS. 7A and 7B is represented by a second capacitance curve 132, and the capacitance of the third exemplary transmission line structure in FIGS. 8A and 8B is represented by a third capacitance curve 142. The use of alternately interlaced transmission line portions in the first exemplary transmission line structure increases capacitance over the reference transmission line components. The combination of the alternately interlaced transmission line portions with an array of metallic fins, as in the second and third exemplary transmission line structures, increases the capacitance of transmission line structures as demonstrated by the second and third capacitance curves (132, 142). Grounding of the array of the metallic fins to a grounding metal plane as in the third exemplary metallic transmission line structure provides the most effective increase in the capacitance of a metallic transmission line structure.

Figure 12:
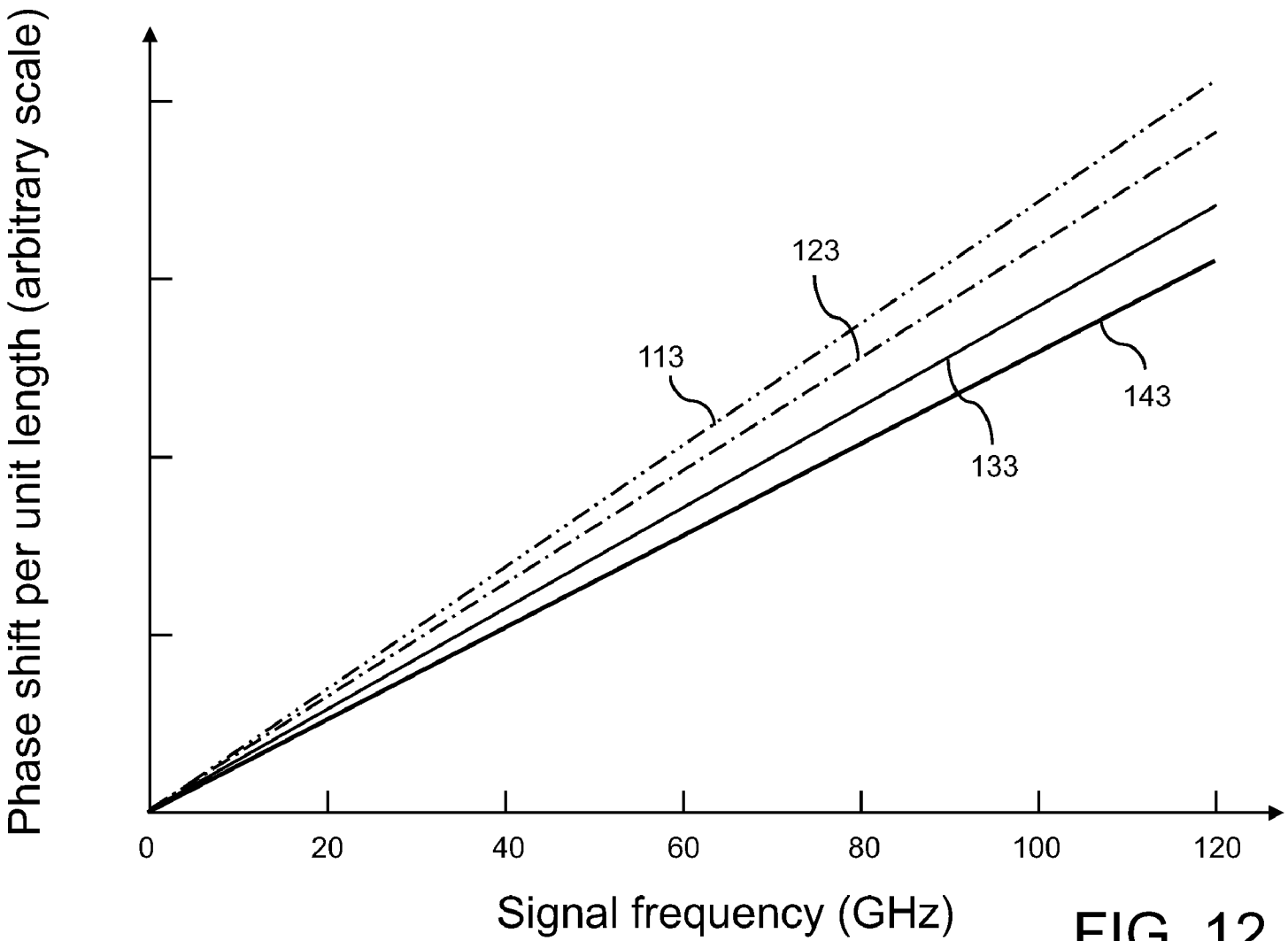
FIG. 12 is a graph of phase shift per unit length for the structures shown in FIGS. 5A and 5B, 6A and 6B, 7A and 7B, and 8A and 8B.

FIG. 12 is a graph of phase shift per unit length for the structures shown in FIGS. 5A and 5B, 6A and 6B, 7A and 7B, and 8A and 8B. In general, the phase velocity of the signal is inversely proportional to the product of the inductance per unit length L and the capacitance per unit length C in the circuit schematic in FIG. 9. By increasing the inductance per unit length L or the capacitance per unit length C of the circuit in FIG. 9, the phase velocity of an electromagnetic signal may be reduced. The relative phase velocities in the reference transmission line structure and the first, second, and third exemplary transmission line structures are shown by a reference phase shift curve 113, a first phase shift curve 123, a second phase shift curve 133, and a third phase shift curve 143. The first, second, and third phase shift curves (123, 133, 143) show lesser phase shift than the reference phase shift curve 113, providing less phase shift per unit length of a metallic transmission line structure.

Figure 13:
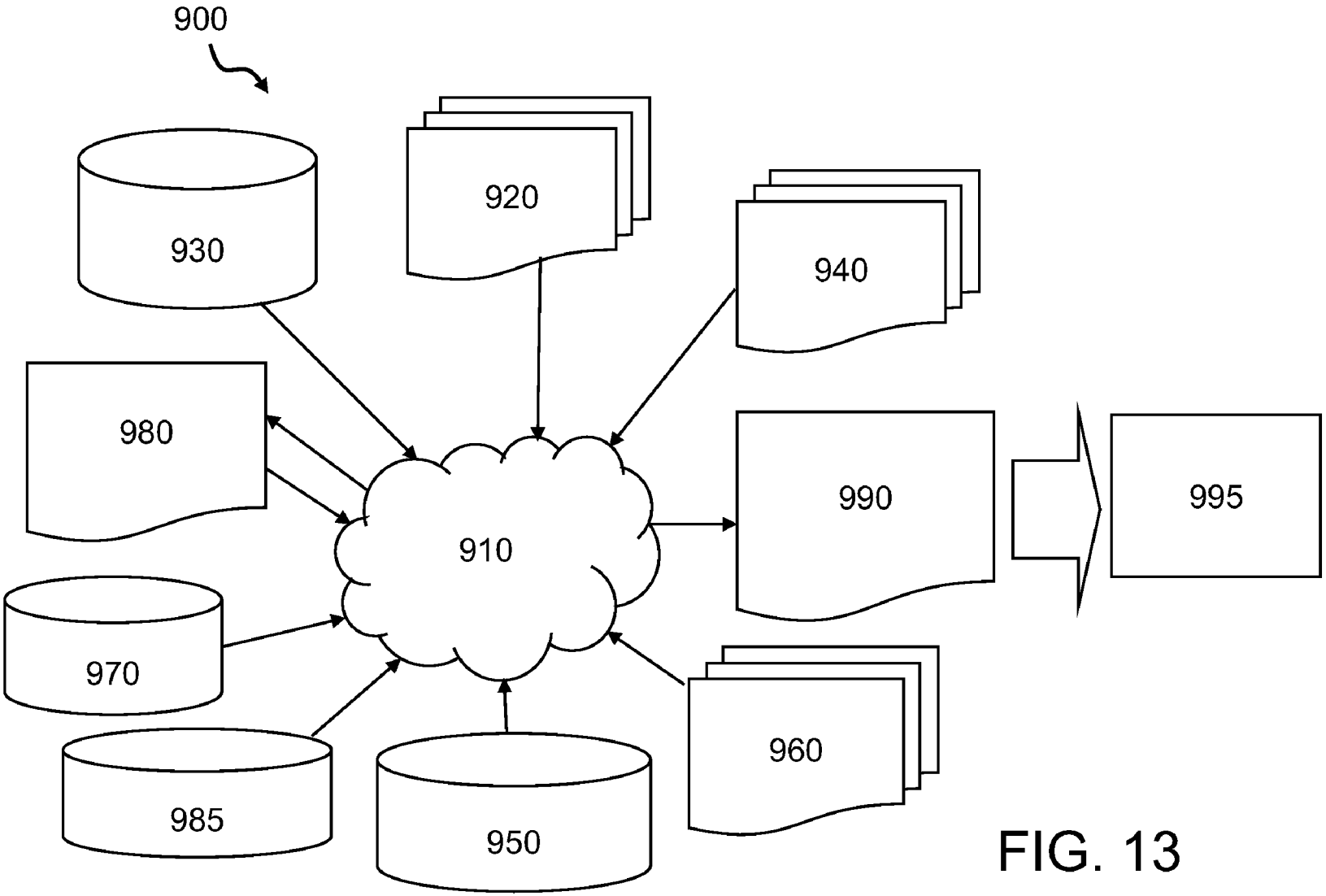
FIG. 13 is a flow diagram of a design process used in semiconductor design and manufacture of the semiconductor structures according to the present invention.

FIG. 13 shows a block diagram of an exemplary design flow 900 used for example, in semiconductor IC logic design, simulation, test, layout, and manufacture. Design flow 900 includes processes and mechanisms for processing design structures or devices to generate logically or otherwise functionally equivalent representations of the design structures and/or devices described above and shown in FIGS. 1A-1D, 2A-2D, 3A-3F, 4A-4F, 5A, 5B, 6A, 6B, 7A, 7B, 8A, 8B, and 9. The design structures processes and/or generated by design flow 900 may be encoded on machine-readable transmission or storage media to include data and/or instructions that, when executed or otherwise processes on a data processing system, generate a logically, structurally, mechanically, or otherwise functionally equivalent representation of hardware components, circuits, devices, or systems. Design flow 900 may vary depending on the type of representation being designed. For example, a design flow for building an application specific integrated circuit (ASIC) may differ from a design flow 900 for designing a standard component or from a design flow 900 for instantiating the design into a programmable array, for example, a programmable gate array (PGA) or a field programmable gate array (FPGA) offered by Altera® Inc. or Xilinx® Inc.

FIG. 13 illustrates multiple such design structures including an input design structure 920 that is preferably processed by design process 910. Design structure 920 may be a logical simulation design structure generated and processed by design process 910 to produce a logically equivalent functional representation of a hardware device. Design structure 920 may also, or alternately, comprise data and/or program instructions that, when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 1A-1D, 2A-2D, 3A-3F, 4A-4F, 5A, 5B, 6A, 6B, 7A, 7B, 8A, 8B, and 9. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 1A-1D, 2A-2D, 3A-3F, 4A-4F, 5A, 5B, 6A, 6B, 7A, 7B, 8A, 8B, and 9 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990. Design structure 990 resides on a storage medium or programmable gate array in a data format used for the exchange of data of mechanical devices and structures (e.g. information stored in an IGES, DXF, Parasolid XT, JT, DRG, or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1A-1D, 2A-2D, 3A-3F, 4A-4F, 5A, 5B, 6A, 6B, 7A, 7B, 8A, 8B, and 9. In one embodiment, design structure 990 may comprise a compiled, executable HDL simulation model that functionally simulates the devices shown in FIGS. 1A-1D, 2A-2D, 3A-3F, 4A-4F, 5A, 5B, 6A, 6B, 7A, 7B, 8A, 8B, and 9.

Design structure 990 may also employ a data format used for the exchange of layout data of integrated circuits and/or symbolic data format (e.g. information stored in a GDSII (GDS2), GL1, OASIS, map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1A-1D, 2A-2D, 3A-3F, 4A-4F, 5A, 5B, 6A, 6B, 7A, 7B, 8A, 8B, and 9. Design structure 990 may then proceed to a stage 995 where, for example, design structure 990: proceeds to tape-out, is released to manufacturing, is released to a mask house, is sent to another design house, is sent back to the customer, etc.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

What is claimed is:

1. A structure comprising:

at least one first dielectric material layer located on a substrate;

a grounding metal plane located on a top surface of said at least one first dielectric material layer and vertically separated from said substrate;

at least one second dielectric material layer located on a top surface of said grounding metal plane; and a metallic transmission line embedded in said at least one second dielectric material layer and including first transmission line portions having a first width and second transmission line portions having a second width, wherein said first width and said second width are different, and wherein said first transmission line portions and said second transmission line portions are alternately interlaced; and an array of metallic fins located above said substrate, wherein metallic fins in said array underlie or overlie said second transmission line portions and do not underlie or overlie said first transmission line portions.

2. The structure of claim 1, wherein each first transmission line portion that is not located at an end of said metallic transmission line is laterally abutted by two second transmission line portions, and wherein each second transmission line portion that is not located at an end of said metallic transmission line is laterally abutted by two first transmission line portions.

3. The structure of claim 1, wherein an entirety of said metallic transmission line has a substantially planar top surface and a substantially planar bottom surface.

4. The structure of claim 3, wherein said grounding metal plane has a substantially horizontal top surface and a substantially horizontal bottom surface, and wherein said substantially horizontal top surface is parallel to said substantially planar top surface and said substantially planar bottom surface of said metallic transmission line.

5. The structure of claim 4, wherein said substantially horizontal top surface of said grounding metal plane is parallel to an interface between said substrate and said at least one first dielectric material layer.

6. The structure of claim 1, wherein said second width is greater than said first width, and wherein each of said first transmission line portions comprises a pair of first lengthwise sidewalls abutting said at least one second dielectric material layer and separated by said first width, and wherein each of said second transmission line portions comprises a pair of second lengthwise sidewalls abutting said at least one second dielectric material layer and separated by said second width.

7. The structure of claim 6, wherein each of said second transmission line portions further comprises two pairs of widthwise sidewalls, wherein each pair of widthwise sidewalls is directly adjoined to a second lengthwise sidewall.

8. The structure of claim 6, wherein each of said first transmission line portions has a first horizontal cross-sectional area in a first shape of a first rectangle in which two sides have a dimension of said first width, and wherein each of said second transmission line portions has a second horizontal cross-sectional area in a second shape of a second rectangle in which two sides have a dimension of said second width.

9. The structure of claim 8, wherein two other sides in said first shape of said first rectangle have a dimension of a first length, and wherein two other sides in said second shape of said second rectangle have a dimension of a second length.

10. The structure of claim 9, wherein said metallic transmission line is a one-dimensional periodic array of a unit structure repeated at a distance of an array pitch along a lengthwise direction, wherein said unit structure consists of one of said first transmission line portions and one of said second transmission line portions laterally abutting said one of said first transmission line portions.

11. The structure of claim 1, wherein said metallic transmission line overlies or underlies said grounding metal plane.

12. The structure of claim 1, wherein said array of metallic fins is located between said metallic transmission line and said grounding metal plane and is embedded in said at least one dielectric material layer.

13. The structure of claim 1, wherein each metallic fin in said array comprises a stack of metal portions including at least one line-level metal portion and at least one via-level metal portion, wherein sidewalls of said at least one line-level metal portion and sidewalls of said at least one via portion are substantially vertically coincident with widthwise sidewalls of said second transmission line portions.

14. The structure of claim 1, wherein each metallic fin in said array has a pair of widthwise sidewalls that are perpendicular to a lengthwise direction of said metallic transmission line, wherein said widthwise sidewalls include a direction of said first width and said second width.

15. The structure of claim 1, wherein each metallic fin in said array has a third width, which is greater than said first width and said second width.

16. The structure of claim 1, wherein each of said first transmission line portions has a first length in a lengthwise direction that is perpendicular to a direction of said first width, and wherein each of said second transmission line portions has a second length in said lengthwise direction, wherein each metallic fin said array has a length that is substantially the same as said second length, and wherein metallic fins in said array are separated by a distance that is substantially the same as said first length.

17. The structure of claim 1, wherein said array of metallic fins is electrically floating.

18. The structure of claim 1, wherein said array of metallic fins is resistively connected to said grounding metal plane.

19. The structure of claim 1, wherein said array comprises at least one metallic fin located within a line-level metal interconnect layer and at least another metallic fin located within a via-level metal interconnect layer.

20. A method of operating a metallic transmission line structure, said method comprising:

providing a metal transmission line structure including:

at least one first dielectric material layer located on a substrate;

a grounding metal plane located on a top surface of said at least one first dielectric material layer and vertically separated from said substrate;

at least one second dielectric material layer located on a top surface of said grounding metal plane; and a metallic transmission line embedded in said at least one second dielectric material layer and including first transmission line portions having a first width and second transmission line portions having a second width, wherein said first width and said second width are different, and wherein said first transmission line portions and said second transmission line portions are alternately interlaced; and an array of metallic fins located above said substrate, wherein metallic fins in said array underlie or overlie said second transmission line portions and do not underlie or overlie said first transmission line portions;

electrically grounding said grounding metal plane; and applying a radio frequency (RF) signal across a first end of said metallic transmission line and said grounding metal plane.

21. The method of claim 20, wherein said array comprises at least one metallic fin located within a line-level metal interconnect layer and at least another metallic fin located within a via-level metal interconnect layer.

22. The method of claim 20, further comprising receiving another RF signal across a second end of said metallic transmission line and said grounding metal plane, wherein said another RF signal is phase delayed relative to said RF signal.

23. The method of claim 22, wherein said RF signal is applied to said first end of said metallic transmission line and said grounding metal plate through a first semiconductor device located on said substrate, and wherein said other RF signal is received by a second semiconductor device located on said substrate.

24. The method of claim 20, wherein said second width is greater than said first width, and wherein each of said first transmission line portions comprises a pair of first lengthwise sidewalls abutting said at least one second dielectric material layer and separated by said first distance, and wherein each of said second transmission line portions comprises a pair of second lengthwise sidewalls abutting said at least one second dielectric material layer and separated by said second distance.

25. The method of claim 20, wherein said metal transmission line structure further comprises an array of metallic fins located between said metallic transmission line and embedded in said at least one second dielectric material layer.

26. The method of claim 20, wherein each metallic fin in said array comprises a stack of metal portions including at least one line-level metal portion and at least one via-level metal portion, wherein sidewalls of said at least one line-level metal portion and sidewalls of said at least one via portion are substantially vertically coincident with widthwise sidewalls of said second transmission line portions.

27. A non-transitory machine readable medium embodying a design structure representing a design for a semiconductor chip, said design structure comprising:

a first data representing a substrate;

a second data representing at least one first dielectric material layer located on said substrate;

a third data representing a grounding metal plane located on a top surface of said at least one first dielectric material layer and vertically separated from said substrate;

a fourth data representing at least one second dielectric material layer located on a top surface of said grounding metal plane; and a fifth data representing a metallic transmission line embedded in said at least one second dielectric material layer and including a sixth data representing first transmission line portions having a first width and a seventh data representing second transmission line portions having a second width, wherein said first width and said second width are different, and wherein said first transmission line portions and said second transmission line portions are alternately interlaced; and an eighth data representing an array of metallic fins located above said substrate, wherein metallic fins in said array underlie or overlie said second transmission line portions and do not underlie or overlie said first transmission line portions.

28. The non-transitory machine readable medium of claim 27, wherein an entirety of said metallic transmission line represented by said fifth data has a substantially planar top surface and a substantially planar bottom surface.

29. The non-transitory machine readable medium of claim 28, wherein said third data includes a first additional data representing a substantially horizontal top surface and a second additional data representing a substantially horizontal bottom surface, and wherein said substantially horizontal top surface is parallel to said substantially coplanar top surface and said substantially coplanar bottom surface of said metallic transmission line.

30. The non-transitory machine readable medium of claim 29, wherein said substantially horizontal top surface of said grounding metal plane is parallel to an interface between said substrate and said at least one first dielectric material layer.

31. The non-transitory machine readable medium of claim 27, wherein said second width is greater than said first width, and wherein each subset of said sixth data representing a first transmission line portion comprises a first additional data representing a pair of first lengthwise sidewalls abutting said at least one second dielectric material layer and separated by said first distance, and wherein each subset of said seventh data representing a second transmission line portion comprises a second additional data representing a pair of second lengthwise sidewalls abutting said at least one dielectric material layer and separated by said second distance.

32. The non-transitory machine readable medium of claim 31, wherein each subset of said seventh data further comprises another data representing two pairs of widthwise sidewalls, wherein each pair of widthwise sidewalls is directly adjoined to a second lengthwise sidewall.

33. The non-transitory machine readable medium of claim 27, wherein each first transmission line portion represented by said sixth data and not located at an end of said metallic transmission line is laterally abutted by two second transmission line portions, and wherein each second transmission line portion represented by said seventh data and not located at an end of said metallic transmission line is laterally abutted by two first transmission line portions.

34. The non-transitory machine readable medium of claim 27, wherein said array comprises at least one metallic fin located within a line-level metal interconnect layer and at least another metallic fin located within a via-level metal interconnect layer.

35. The non-transitory machine readable medium of claim 27, wherein each metallic fin in said array comprises a stack of metal portions including at least one line-level metal portion and at least one via-level metal portion, wherein sidewalls of said at least one line-level metal portion and sidewalls of said at least one via portion are substantially vertically coincident with widthwise sidewalls of said second transmission line portions.

* * * * *